US010046590B2

(12) United States Patent
Lazzari et al.

(10) Patent No.: US 10,046,590 B2
(45) Date of Patent: Aug. 14, 2018

(54) METHOD FOR PRODUCING A BACK-LIT COLOUR LASER IMAGE, IDENTITY DOCUMENT USING THIS METHOD AND BACK LIGHTING SYSTEM

(76) Inventors: Jean Pierre Lazzari, Sainte Maxime (FR); Jean Marc Lazzari, Saint Remy l'Honore (FR)

( * ) Notice: Subject to any disclaimer, the term of this patent is extended or adjusted under 35 U.S.C. 154(b) by 1284 days.

(21) Appl. No.: 14/004,157

(22) PCT Filed: Mar. 8, 2012

(86) PCT No.: PCT/FR2012/000081

§ 371 (c)(1),
(2), (4) Date: Sep. 9, 2013

(87) PCT Pub. No.: WO2012/120207

PCT Pub. Date: Sep. 13, 2012

(65) Prior Publication Data

US 2013/0341900 A1 Dec. 26, 2013

(30) Foreign Application Priority Data

Mar. 10, 2011 (FR) ..... 11/00713

(51) Int. Cl.
*B42D 25/00* (2014.01)
*B42D 25/351* (2014.01)
(Continued)

(52) U.S. Cl.
CPC ..... *B42D 25/41* (2014.10); *B41J 2/44* (2013.01); *B41J 2/442* (2013.01); *B41M 3/148* (2013.01);
(Continued)

(58) Field of Classification Search
CPC . B41J 2/44–2/442; B41M 5/24; B42D 25/351
See application file for complete search history.

(56) References Cited

U.S. PATENT DOCUMENTS 5,350,198 A * 9/1994 Bernecker ..... B42D 25/00 283/67
5,932,318 A 8/1999 Uchiyamam
(Continued)

FOREIGN PATENT DOCUMENTS

EP 1918123 A1 * 5/2008 ..... B42D 25/00
WO 2008/139045 11/2008

OTHER PUBLICATIONS

International Search Report and Written Opinion dated Jun. 12, 2012 for International Application No. PCT/FR2012/000081 filed Mar. 8, 2012, pp. 1-10.

*Primary Examiner* — Kyle R Grabowski
(74) *Attorney, Agent, or Firm* — MH2 Technology Law Group, LLP

(57) ABSTRACT

This disclosure includes a system and method for producing a back-lit color laser image, and an identity document using this method and back lighting system. The body of the identity document may be transparent. In various implementations, the light back-lights the color laser image which may be formed of sub-pixels partly covered by non-reflective surfaces in the protective layer. The light may enter through tiny holes in decorative patterns on the reverse side of the document. Various implementations may find particular applications for identity cards, credit cards, passports, driving licences, secure entry badges, etc.

8 Claims, 3 Drawing Sheets

(51) Int. Cl.

| | |
|---|---|
| ***B41J 2/44*** | (2006.01) |
| ***B41M 3/14*** | (2006.01) |
| ***B42D 25/41*** | (2014.01) |
| ***B42D 25/346*** | (2014.01) |
| ***B41M 5/26*** | (2006.01) |
| ***B41M 5/34*** | (2006.01) |
| ***G07D 7/128*** | (2016.01) |

(52) U.S. Cl.

CPC ..... *B41M 5/267* (2013.01); *B41M 5/34* (2013.01); *B42D 25/00* (2014.10); *B42D 25/346* (2014.10); *B42D 25/351* (2014.10); *G07D 7/128* (2013.01); *B41M 3/14* (2013.01); *B42D 2035/06* (2013.01); *B42D 2035/36* (2013.01)

(56) References Cited

U.S. PATENT DOCUMENTS

| | | | | |
|---|---|---|---|---|
| 6,095,566 | A * | 8/2000 | Yamamoto ..... | B42D 25/00 283/107 |
| 6,633,321 | B1 * | 10/2003 | Maurer ..... | B42D 25/00 283/77 |
| 9,001,173 | B2 | 4/2015 | Lazzari et al. | |
| 9,035,986 | B2 | 5/2015 | Lazzari et al. | |
| 9,266,350 | B2 | 2/2016 | Lazzari et al. | |
| 2003/0011868 | A1 | 1/2003 | Zehner et al. | |
| 2005/0230959 | A1 * | 10/2005 | Nemeth ..... | B42D 25/00 283/74 |
| 2014/0361527 | A1 | 12/2014 | Lazzari et al. | |

* cited by examiner

METHOD FOR PRODUCING A BACK-LIT COLOUR LASER IMAGE, IDENTITY DOCUMENT USING THIS METHOD AND BACK LIGHTING SYSTEM

CROSS-REFERENCE TO RELATED APPLICATIONS

This application is a U.S. National Stage application of International Patent Appl. No. PCT/FR2012/000081 filed Mar. 8, 2012, which claims priority to French Application Ser. No. 11/00713 filed Mar. 10, 2011, the entire disclosures of which are hereby incorporated by reference in their entireties.

FIELD OF APPLICATION OF THE INVENTION

The subject of the present invention is a method for forming a back-lit colour laser image in an identity document carrying a back-lit colour laser image, and a backlighting system. It finds applications in particular for identity cards, credit cards, passports, driving licences, secure entry badges, etc.

STATE OF THE PRIOR ART

Colour laser images composed of sub-pixels in the primary additive colours, red, green and blue, abbreviated in the remainder hereof to RGB, require either a device with high reflective yield as described in patent application FR 11/00578 filed on Feb. 28, 2011 or back lighting as used for Liquid Crystal Displays (LCDs). LCD screens are composed of a matrix of RGB pixels behind which there lies a block of liquid crystal cells and finally a back light which illuminates this assembly from behind causing the colour images to appear.

The aforementioned patent application describes the personalisation of a colour laser image formed of sub-pixels (R,G,B) printed underneath a protective layer, the said layer is then hot welded under pressure onto the body of an identity document. This hot welding under pressure of the protective layer is known in the trade as "lamination".

A laser beam through the transparent protective sheet via carbonization produces dark, non-reflective surfaces in this transparent protective sheet which partly or wholly mask each sub-pixel (R,G,B) thereby forming the grey levels of a personalised colour laser image of high quality. The transparent protective sheet is commonly called "laserable" since it is sensitive to laser radiation.

Although of advantage in some respects, these colour laser images, depending on the environment in which they are observed, may require illumination to reinforce the luminosity of the image.

DISCLOSURE OF THE INVENTION

It is the objective of the present invention to overcome this disadvantage by proposing a method for producing an identity document comprising a personalised colour laser image which is back-lit.

This objective of the invention is achieved by means of a transparent identity document body through which a light flow passes which back lights the personalised colour laser image.

More specifically, the subject of the invention is a method for forming a back-lit personalised colour laser image comprising sub-pixels in the additive primary colours red green and blue. These sub-pixels are protected by a transparent laserable sheet. A laser beam via carbonization above each sub-pixel (R,G,B) causes the grey levels of a personalised colour laser image to appear in the transparent laserable protective sheet. The body of the document is transparent and a light flow passes through it which back lights the personalised colour laser image perpendicular to its plane.

The front side of the identity document comprises a laserable protective sheet which protects the sub-pixels (R,G,B) and the decorative patterns and anti-counterfeit systems. The reverse side carries decorative patterns and an anti-counterfeit system also protected by a transparent sheet laminated on the reverse side of the identity document.

According to a first embodiment of the invention, the light flow enters perpendicular to the plane of the document via the reverse side of the document through an opening made in the decorative patterns and anti-counterfeit systems.

According to one variant of the invention, the reverse side is fully covered by decorative patterns or anti-counterfeit systems. On one surface substantially equal to the surface of the personalised image on the front side of the identity document, and opposite the latter on the reverse side, the decorative patterns and anti-counterfeit system are pierced with tiny holes that are uniformly distributed and allow the passing of a light flow from a source located on the back of the identity document the flow passing through the document perpendicular the plane thereof. This light flow illuminates the personalised colour laser image from behind. The decorative patterns, anti-counterfeit systems and tiny holes are coated with a protective layer laminated on the reverse side of the identity document.

According to another embodiment of the invention, the light enters via least one side of the identity document through its thickness. Diffracting elements located underneath the personalised colour laser image scatter and send the light to behind this image passing through it perpendicular to its plane. Reflective means located on the reverse side of the identity document enhance the intensity of the light sent through the personalised laser image. The identity document is covered with decorative patterns and anti-counterfeit systems on its two sides.

The invention also concerns an identity document comprising a colour laser image back-lit by implementing the above method. This identity document comprises a sheet of laserable material acting as protective layer, this sheet being at least partly carbonized by laser radiation, sub-pixels (R,G,B) printed between the laserable sheet and a transparent document substrate, these sub-pixels (R,G,B) forming an image back-lit by a light flow passing perpendicularly through the image perpendicular to the plane of the document.

According to particular embodiments:

- The light enters via the back of the identity document through an opening made in the decorative and anti-counterfeit elements located on the reverse side of the document.
- The light enters by the back of the identity document, via uniformly distributed tiny holes through the decorative and anti-counterfeit elements located on the reverse side of the document.
- The light enters via at least one side of the body of the identity document through its thickness. The light is diffracted by diffraction elements and passes through the colour laser image in the observer's direction. Reflective means located on the reverse side of the body of the document increase the flow of light.

Finally the invention concerns an edge back lighting system capable of illuminating an identity document as previously described. It comprises a planar base on which the identity document is laid flat, at least one of its sides is placed in contact with at least one light concentrator which captures the light of a light source, and concentrates this light in the thickness of the identity document.

PRESENTATION OF THE FIGURES

The invention will become better apparent after the following description given for explanatory purposes and in no way limiting. This description refers to the appended drawings in which:

FIG. 1 shows the cross-section of an identity document comprising an RGB colour laser image according to the prior art.

FIG. 2 gives a cross-section of an identity document comprising an RGB colour laser image according to a first embodiment of the invention.

DETAILED DESCRIPTION

Figure 1:
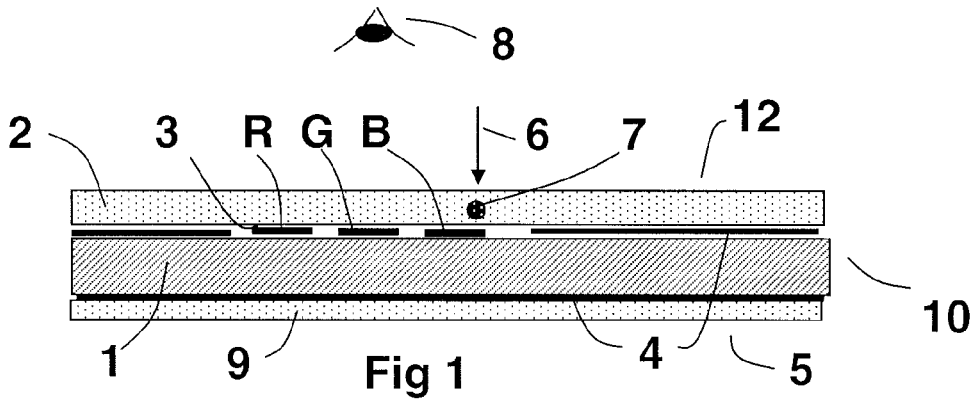

FIG. 1 shows the cross-section (10) of an identity document comprising a colour laser image according to the prior art. It comprises an opaque document body (1), generally white. On its front side (12) a transparent protective laserable sheet (2) is laminated on sub-pixels (R,G,B) (3) and on decorative patterns and anti-counterfeit systems (4). On the reverse side (5) of the identity document there are also decorative patterns and anti-counterfeit systems (4). The whole is protected by a sheet (9) laminated on the reverse side (5) of the identity document.

At a second step a laser beam (6) via carbonization generates the grey levels (7) in the laserable sheet (2) above each sub-pixel (R,G,B), thereby forming the grey levels of a personalised colour laser image. This image is seen by the observer (8) by reflection of ambient light on the personalised colour laser image (3) through the laserable protective sheet (2).

Figure 2:
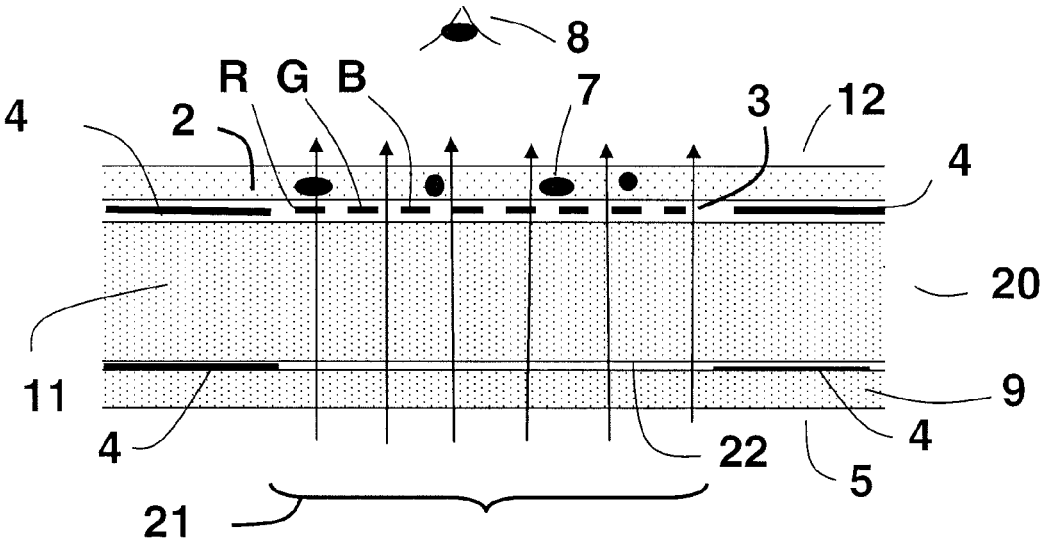

FIG. 2 is a cross-section (20) of an identity document according to a first embodiment of the invention, comprising a back-lit personalised laser image. The body of the document is formed of a transparent sheet (11) which as non-limiting examples can be in polycarbonate, some treated polyvinyl chlorides, treated acrylonitrile-butadiene-styrenes, or treated polyethylene terephthalates. It may be formed of several laminated sheets. Its total thickness is between 50 μm and 1.5 mm. On its front side (12) it comprises the transparent protective sheet (2) which has been laser-treated to form the personalised colour laser image (3). To do so a laser beam via carbonization generates the grey levels (7) above each sub-pixel (R,G,B) located between the transparent protective layer (2) and the transparent body (11) of the identity document, the sub-pixels (R,G,B) and their grey levels (7) forming the personalised colour laser image. All around this personalised colour laser image, on the front side (12) of the identity document, decorative patterns and anti-counterfeit systems (4) have been printed and are also protected by the transparent laserable protective sheet (2).

On the reverse side (5) of the document, decorative patterns and anti-counterfeit systems (4) are printed except on the surface (22) opposite the personalised colour laser image. The elements of the reverse side of the identity document are protected by a transparent protective sheet (9) laminated on this reverse side. A flow of light (21) originating either from an artificial source or from ambient light passes through the back transparent protective sheet (9), the transparent body of the identity document (11) via the opening (22) perpendicular to its plane, and passes from behind through the personalised colour image and the protective sheet (2). The personalised colour laser image via transparency therefore appears to the observer (8) to be efficiently illuminated from behind.

Figure 3:
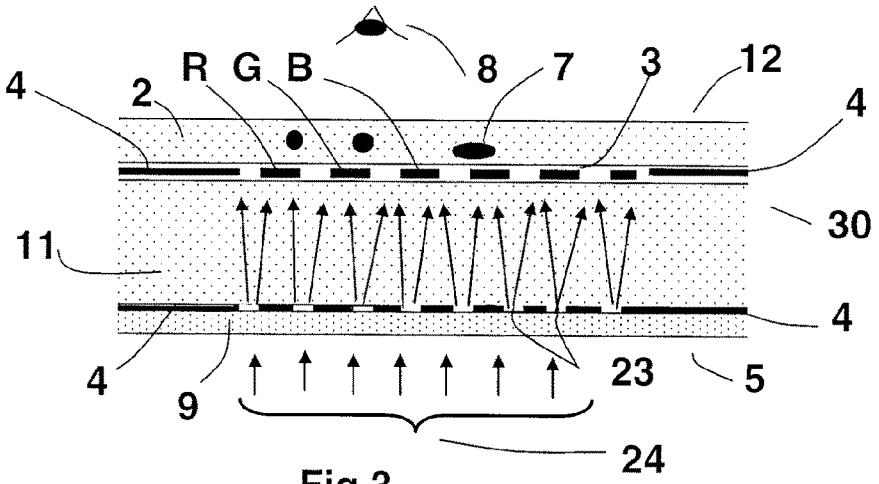
FIG. 3 shows the cross-section of an identity document comprising an RGB colour laser image according to a second embodiment of the invention.

FIG. 3 shows the cross-section (30) of an identity document comprising a back-lit personalised laser image according to a second embodiment of the invention. On the front side (12) of the identity document it comprises the same elements as those described previously, in particular the personalised colour laser image composed of sub-pixels (R,G,B), of the laserable sheet (4) of grey levels (7). It also comprises the decorative and anti-counterfeit elements (4). The reverse side (5) of the identity document carries decorative patterns and anti-counterfeit elements over its entire surface. For back lighting of the personalised colour laser image (3), the light flow enters via the reverse side (5) of the document through tiny holes (23) uniformly distributed and made through the decorative patterns and anti-counterfeit elements, behind the personalised colour laser image so as to allow passing of the light, derived from the source (24), perpendicular to the plane of the document.

These tiny holes do not deteriorate the quality of the decorative patterns or anti-counterfeit systems since they are hardly visible. They have a diameter of between 5 μm and 500 μm. This light, passing through these holes, illuminates the personalised colour laser image from behind. It is seen by the observer (8) via transparency with strong luminosity. All the elements of the reverse side (5) of the identity document are protected by a transparent protective sheet (9) laminated on the reverse side of the identity document.

Figure 4:
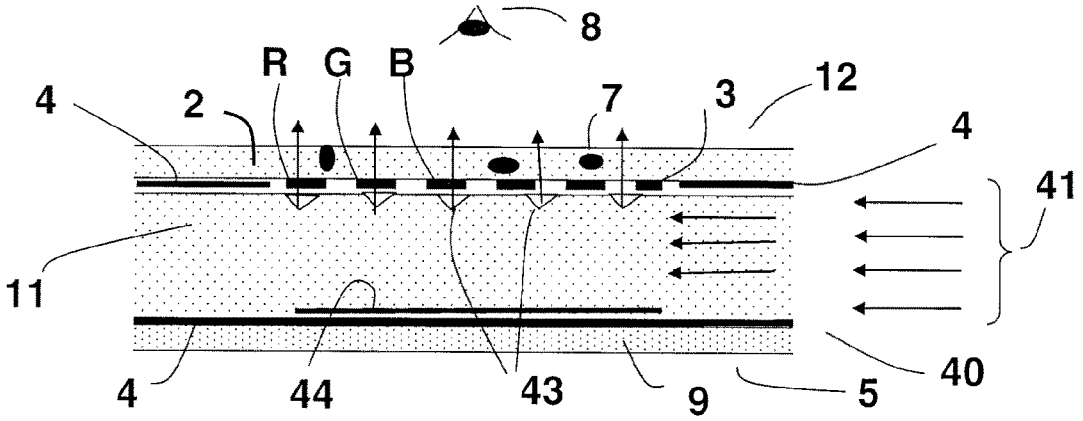
FIG. 4 shows the cross-section of an identity document comprising an RGB colour laser image according to a third embodiment of the invention.

FIG. 4 shows the cross-section (40) of an identity document comprising a back-lit personalised laser image according to a third embodiment of the invention. The front side (12) of the identity document comprises the same elements as those in the preceding Figures, in particular the personalised colour laser image (3) composed of the sub-pixels (R,G,B), of the laserable sheet (2) of grey levels (7). It also comprises the decorative and anti-counterfeit elements (4). On at least one of the sides of the identity document a flow of light (41) created by an artificial source enters into the body of the transparent identity document (11) through its thickness.

On the front side (12) of the body (11) of the identity document there are elements (43) diffracting the light circulating in the thickness of the body of the document (11), and sending it back perpendicularly in the direction of the observer (8) through the personalised colour laser image (3). These diffracting elements (43), known to persons skilled in the art for LCD screens in particular, can be micro-cavities for example formed on the surface of the body (11) of the identity document. To reinforce the intensity of the diffracted light, reflective means (44) are located on the reverse side of the body of the document. These means may be a reflective varnish or a reflective metal foil. These means are covered by the decorative and anti-counterfeit elements (4), the whole being protected by the protective sheet (9) laminated on the reverse side (5) of the identity document.

Figure 5:
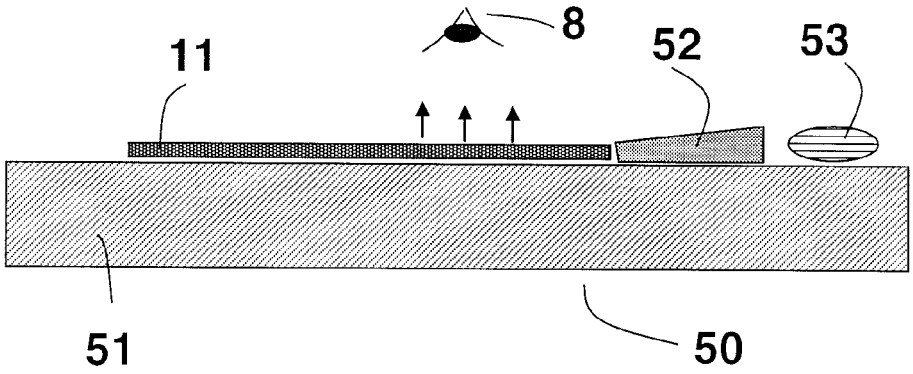
FIG. 5 illustrates a lighting device capable of illuminating an identity document according to the third embodiment of the invention in FIG. 4.

FIG. 5 shows a cross-section (50) of a back lighting system capable of illuminating an identity document as illustrated in FIG. 4. It comprises a planar base (51) on which the identity document (11) is laid flat, characterized in that at least one of its sides is placed in contact with at least one light concentrator which captures the light of a light source and concentrates this light in the thickness of the identity document. The light generating means may advantageously be light emitting diodes (53). They are optically connected to the light concentrator (52) which focuses the flow of light in the thickness of the body (11) of the identity document. The light back-lights the personalised colour laser image which is clearly seen by the observer (8).

The invention claimed is:

1. A method for producing, on a document having a front side and a reverse side, a back-lit personalised colour laser image comprising sub-pixels in the additive primary colours red, green, and blue, protected by a transparent laserable sheet on the front side of the document, the method comprising:

carbonizing, via a laser beam, the transparent laserable protective sheet above the sub-pixels causing grey levels that in combination with the sub-pixels form a personalised colour laser image only on the front side of the document, wherein the document is transparent such that a light flow passes through, which back lights the personalised colour laser image perpendicular to the plane of the document; wherein the reverse side of the document includes printing and an opening in the printing; and wherein the light flow enters perpendicular to the plane of the document via the reverse side of the document through the opening.

2. The method for producing a back-lit personalised colour laser image according to claim 1, wherein the reverse side of the document includes printing and a plurality of uniformly distributed holes in the printing; and wherein the light flow originates from a source behind the document and enters via the reverse side of the document through the plurality of uniformly distributed holes, and illuminates the personalised colour laser image from behind.

3. The method according to claim 1, wherein the printing comprises at least one of a decorative pattern or an anti-counterfeit system.

4. An identity document comprising a back-lit colour laser image produced by implementing the method according to claim 1, wherein the identity document comprises:

a sheet of laserable material, acting as a protective layer on the front side of the document, which is at least partly carbonized by laser radiation to form grey levels;

a transparent document substrate; and sub-pixels printed between the transparent document substrate and the sheet of laserable material, wherein the sub-pixels and the grey levels form a colour laser image only on the front side of the document, wherein the colour laser image is back-lit by a light flow passing through the colour laser image perpendicular to the plane of the identity document; wherein the reverse side of the document includes printing and an opening in the printing; and wherein the light flow enters via the reverse side of the identity document through the opening.

5. The identity document according to claim 4, wherein the reverse side of the document includes printing and a plurality of uniformly distributed holes in the printing; and wherein the light enters via the reverse side of the identity document through the plurality of uniformly distributed holes.

6. The identity document according to claim 4, wherein the printing comprises at least one of a decorative pattern or an anti-counterfeit system.

7. A method for producing a back-lit colour image on a document of claim 6, wherein the at least one opening comprises a plurality of uniformly distributed holes.

8. A method for producing a back-lit colour image on a document, wherein the document comprises:

a front side;

a transparent body;

a transparent laserable sheet disposed on the front side of the document;

a layer of red, green, and blue subpixels between the transparent body and the transparent laserable sheet, wherein the layer of red, green, and blue subpixels do not form an image by themselves; and a layer of ink on a surface of the transparent body that is opposite the front side of the document, wherein the layer of ink includes at least one opening, the method comprising:

(a) pointing a laser beam at a point on the front side of the document that is opposite the at least one opening, wherein the point is above one or more selected subpixels;

(b) carbonizing the transparent laserable sheet to generate a grey level in the transparent laserable sheet; and (c) repeating steps (a) and (b) to form the back-lit colour image from a plurality of the grey levels and a plurality of the subpixels when viewed from the front side of the document;

wherein light passes through the at least one opening and through the transparent body to back light the colour image that was formed.

* * * * *